US006595612B1

(12) United States Patent
Brown et al.

(10) Patent No.: US 6,595,612 B1
(45) Date of Patent: Jul. 22, 2003

(54) INKJET PRINTER CAPABLE OF MINIMIZING CHROMATIC VARIATION IN ADJACENT PRINT SWATHS WHEN PRINTING COLOR IMAGES IN BIDIRECTIONAL MODEL

(75) Inventors: Christopher M. Brown, Phoenix, AZ (US); Hideo Noda, Tokyo (JP); Toru Hayashi, Tokyo (JP)

(73) Assignee: Mutoh Industries Ltd., Tokyo (JP)

( * ) Notice: Subject to any disclaimer, the term of this patent is extended or adjusted under 35 U.S.C. 154(b) by 0 days.

(21) Appl. No.: 09/510,484

(22) Filed: Feb. 23, 2000

(51) Int. Cl.[7] ..... B41J 29/38; B41J 2/205; B41J 2/15; B41J 2/21

(52) U.S. Cl. ..... 347/9; 347/5; 347/15; 347/40; 347/43

(58) Field of Search ..... 347/5, 9, 15, 40, 347/41, 43

(56) References Cited

U.S. PATENT DOCUMENTS 4,540,996 A * 9/1985 Saito ..... 347/43
4,593,295 A * 6/1986 Matsufuji et al. ..... 347/43
4,748,453 A * 5/1988 Lin et al. ..... 347/41
4,952,942 A * 8/1990 Kanome et al. ..... 347/43
5,583,550 A * 12/1996 Hickman et al. ..... 347/41
5,831,642 A * 11/1998 Matsubara et al. ..... 347/9
5,903,712 A * 5/1999 Wang et al. ..... 395/109
5,949,453 A 9/1999 Harris et al. ..... 347/43
6,033,055 A * 3/2000 Nagoshi et al. ..... 347/43
6,315,387 B1 * 11/2001 Horikoshi ..... 347/40

FOREIGN PATENT DOCUMENTS

EP 0955174 A2 * 11/1999 ..... B41J/19/14

* cited by examiner

*Primary Examiner*—Hai Pham
*Assistant Examiner*—Alfred Dudding
(74) *Attorney, Agent, or Firm*—Webb Ziesenheim Logsdon Orkin & Hanson, P.C.

(57) ABSTRACT

An inkjet printer capable of minimizing chromatic variation due to an ink overlapping (or overlaying) order when printing in a bidirectional mode. Bright color ink dots and dark color ink dots are arranged alternately within the same swath when printing in the bidirectional mode. Plural swaths with different overlapped colors consisting of these dots are arranged alternately in both the main and sub directions to perform overall chromatic averaging.

4 Claims, 17 Drawing Sheets

FIG. 16

| | 1 | 2 | 3 | 4 | 5 | 6 | |
|---|---|---|---|---|---|---|---|
| A | YOM | GCK | YOM | GCK | YOM | GCK | FIRST R → |
| B | KCG | MOY | KCG | MOY | KCG | MOY | ← FIRST L |
| C | YOM | GCK | YOM | GCK | YOM | GCK | SECOND R → |
| D | KCG | MOY | KCG | MOY | KCG | MOY | ← SECOND L |

FIG. 17

| | 1 | 2 | 3 | 4 | 5 | 6 |
|---|---|---|---|---|---|---|
| A | YOMKCG | GCKMOY | YOMKCG | GCKMOY | YOMKCG | GCKMOY |
| B | KCGYOM | MOYGCK | KCGYOM | MOYGCK | KCGYOM | MOYGCK |

INKJET PRINTER CAPABLE OF MINIMIZING CHROMATIC VARIATION IN ADJACENT PRINT SWATHS WHEN PRINTING COLOR IMAGES IN BIDIRECTIONAL MODEL

BACKGROUND OF THE INVENTION

1. Field of the Invention

The present invention relates to an inkjet printer designed to print color images comprised of process colors as defined by the subtractive color model, and more particularly to an inkjet printer capable of reducing and/or eliminating chromatic variation in adjacent print swaths when printing in a bidirectional mode.

2. Description of the Related Art

There have been known such output devices of inkjet, laser beam, thermal, and thermal transfer types, as printers for computers and word processors and raster plotters for CAD systems in the art.

Among those, an inkjet printer is possible to print a high-precision image at a high-speed by firing inks on a print medium such as paper from a print head. The inkjet printers have grown popular for the public use along with the current widespread use of computers. The most employed color printers are such types that are capable of firing several color inks from one print head. In particular, they can be used mostly for printing images with multi-color/multi-tone processed by the computers.

In such the inkjet printer, the print head is scanned in a direction across a print paper (the main scan direction) in order to print a printable region per scan. At the same time, the print paper is advanced in a direction perpendicular to the main scan direction (the sub scan direction). The print head generally comprises a plurality of head-segments arrayed in the main scan direction. Each head-segment responds to each ink color. Each head-segment has a plurality of nozzles arranged at different locations in the sub scan direction. A color printing is performed in accordance with the subtractive color model. The subtractive color model is represented typically with a combination, CMY, of cyan (C), magenta (M) and yellow (Y) inks or a more common combination, CMYK, of CMY plus black (K) ink. There are various extensions such as CMYK plus light-density magenta (LM) and light-density cyan (LC), light-density black, and/or spot colors of orange, green, red and blue.

A common configuration would currently be a print head with four head-segments, one per color, arranged in a nozzle order of KCMY so that when printing in a unidirectional mode the K ink is the first to be placed on the print paper, followed by C, M, and finally Y ink.

The limitation of this design is that, should the printer be designed to print in a bidirectional mode, to improve overall print speed, each alternate print swath (the reverse print swath) would be created by placing the Y ink on the paper first, followed by M, C, and finally K ink contrarily to the forward print swath.

The result of this method of printing is a noticeable chromatic variation in adjacent print swaths, since a swath printed with an ink order of K, C, M, and Y would appear "lighter" to the human observer than a swath printed with an ink order of Y, M, C, and K. This phenomenon is due to the fact that each of the four standard subtractive process colors has a unique brightness distinguishable to the human eye.

The KCMY method of printing is based on the notion that optimum color reproduction is achieved with the subtractive color process by printing the darkest color, black (K), first followed by a brighter color than black, cyan(C), and so on. As an example, in a six-color system comprised of KCMY plus LC and LM, the LC and LM follow Y in the optimum order of lay down.

However, because both print speed and image quality must be balanced to achieve optimum commercial viability, along with responding to the demands from the market including a rapid shipment and cost-down, most inkjet printers support a bidirectional print mode, which has the effect of reducing print time by a factor of 25 to 30 percent compared to the unidirectional print mode.

This increase in print speed, however, can normally only be achieved by sacrificing image quality, specifically a noticeable "banding" that occurs in parts of, or on occasion throughout the entire image. This phenomenon can be reduced by interleaving print swaths, but cannot be entirely eliminated.

FIGS. 18A–C illustrate a theoretical model of an interleaved print swath using a print head with a vertical dot pitch of $1/80^{th}$ inch, printing with a horizontal resolution of 360 dots-per-inch (dpi).

As shown in FIG. 18A, when a print head 100 travels forward on a first pass (shown by an arrow R1) in the main scan direction first, ink nozzles 101 mounted on the print head 100 fire inks, creating a printed part with a horizontal resolution of 360 dpi and a vertical resolution of 180 dpi. In this forward print operation, all dots are printed in KCMY order: the brightest color is printed finally.

The print head 100 is then stepped a certain distance (for example, a ½-tall print swath) down in the sub scan direction as shown in FIG. 18B, and the print head 100 travels reverse on a second pass in the main scan direction. At the same time, inks are fired from the ink nozzles 101 to create a printed part with a horizontal resolution of 360 dpi and a vertical resolution of 180 dpi. As a result of these forward and reverse print operations, a ½-tall full dot print swath SWT1 is created with both horizontal and vertical resolutions of 360 dpi. In this reverse print operation, all dots are printed in YMCK order: the darkest color is printed finally.

The print head 100 is further stepped a certain distance down in the sub scan direction as shown in FIG. 18C, the print head 100 travels on the first pass again (shown by an arrow R2). At the same time, inks are fired from the ink nozzles 101 to create a printed part with a horizontal resolution of 360 dpi and a vertical resolution of 180 dpi. As a result of these reverse and forward print operations, another ½-tall full dot print swath SWT2 is created with both horizontal and vertical resolutions of 360 dpi. In this forward print operation, all dots are printed in KCMY order: the brightest color is printed again finally.

A study of the theoretical model illustrated above would indicate that interleaving each print swath would eliminate chromatic variation in adjacent print swaths, since each swath would consist of an equal number of vertically interlaced dots of alternating density. However, the above model does not take into account the phenomenon of dot gain, which results in a small overlapping of adjacent dots.

Dot gain occurs when an ink droplet of a given size increases in diameter as it dries on the substrate surface. This mechanism is necessary to ensure optimum image quality and color saturation; without adequate dot gain, a printed image will appear "washed out," since too much of the underlying surface (typically white in color) would show through between the gaps in the dots.

FIG. 19 details the dot gain in the above theoretical model. As shown in FIG. 19A, when the print head 100 performs the reverse operation, low-brightness dots D2 are laid on top of high-brightness dots D1. Dot gain in this case gives "darker" impression to the human eye as seen from the printed result 110*a*. To the contrary, when the print head 100 performs the second forward operation as shown in FIG. 19B, high-brightness dots D1 are laid on top of low-brightness dots D2, resulting in "lighter" impression as seen from the printed result 110*b*. A complete printed image obtained through such the print operations can be observed darker in the swath SWT1 in case of right-to-left operations (L1, L2, . . . , Ln) performed by the print head, and lighter in the swath SWT2 in case of left-to-right operations (R1, R2, . . . , Rn). Higher vertical resolution is often achieved by tighter interleaving of each print swath, chromatic variations tend to become less noticeable on higher resolution printers. However, the degree of chromatic variation such as banding in adjacent print swaths remains the same.

SUMMARY OF THE INVENTION

The present invention is made in consideration of such the disadvantages and accordingly has an object to provide an inkjet printer capable of effectively preventing chromatic variations such as banding due to color overlapping (or overlaying) order variations during printing in a bidirectional mode.

The present invention is provided with an inkjet printer, which comprises an inkjet head having a plurality of nozzles arrayed in the main scan direction, each for firing a different color ink. The inkjet printer also comprises head control means for driving the inkjet head relative to a print medium in the main scan direction and the sub scan direction perpendicular to the main scan direction and for providing the inkjet head with firing pulses to fire inks in synchronization with the driving the inkjet head. Droplets of the inks fired from the nozzles for respective colors are overlapped (or overlaid) at each dot-forming position on the print medium to form a color image. The control means provides the inkjet head with the firing pulses in such a manner that different chromatic dots, caused by the difference of the degree of overlapped inks fired from respective nozzles of the inkjet head between the case of transporting the inkjet head on a first directional pass in the main scan direction and the case of transporting the inkjet head on a second directional pass opposite to the first directional pass, are alternately arranged in both the main and sub scan directions.

The inkjet head for the inkjet printer according to the present invention may include the following types. A first example would be an inkjet head, which may consist of first and second segment groups arrayed in the main scan direction, each group being driven independently. The first segment group has nozzles arranged in an order of the brightest color, a mid-bright color and the darkest color along the first directional pass from upstream to downstream. The second segment group has nozzles arranged in an order of the darkest color, a mid-bright color and the brightest color along the first directional pass from upstream to downstream. In this case, the head control means provides the firing pulses to the inkjet head in such a manner that dots by the first segment group and dots by the second segment group are alternately formed during transporting the inkjet head in the main scan direction.

A second example would be an inkjet head, which may consist of first and second segment groups arrayed in the main scan direction. Each group is driven independently, offset to the other by a certain dot pitch in the sub direction, and has nozzles arrayed in the main scan direction. Each of the first and second segment groups has nozzles arranged along the first directional pass from upstream to downstream in an order of the brightest color, a mid-bright color and the darkest color. In this case, the head control means provides the firing pulses to the inkjet head in such a manner that dots by the first segment group and dots by the second segment group are alternately formed at the same dot location in the sub scan direction and every other dot location in the main scan direction in the case of transporting the inkjet head on the first directional pass in the main scan direction and subsequently, in the case of transporting the inkjet head on the second directional pass, dots are formed at intervals between the dots formed in the case of transporting the inkjet head on the first directional pass.

The head control means of the inkjet printer according to the present invention may provide the firing pulses to the inkjet head in such a manner that dots are formed on each odd dot location in both the main scan direction and the sub scan direction with a first scan by the inkjet head traveling on the first directional pass in the main scan direction, subsequently dots are formed on even dot location in the main scan direction and odd dot location in the sub scan direction with a second scan by the inkjet head traveling on the second directional pass, then dots are formed on even dot location in the main scan direction and even dot location in the sub scan direction with a third scan by the inkjet head traveling on the first directional pass after shifting the inkjet head by a certain distance in the sub scan direction, and subsequently dots are formed on odd dot location in the main scan direction and even dot location in the sub scan direction with a fourth scan by the inkjet head traveling on the second directional pass.

The inkjet head may preferably consist of six head-segments for forming one dot with different colors. The six head-segments are divided into first and second groups each with three head-segments, each group being individually driven.

According to the present invention, different chromatic dots caused from the difference between the directional passes for transporting the inkjet head when printing in the inkjet printer are alternately arranged in both the main and sub scan directions. This enables the printer to print an image chromatically averaged with low-brightness parts and high-brightness parts that are evenly distributed. Thus, the banding due to the printing directional passes can be effectively prevented.

Other features and advantages of the invention will be apparent from the following description of the preferred embodiments thereof.

BRIEF DESCRIPTION OF THE DRAWINGS

The present invention will be more fully understood from the following detailed description with reference to the accompanying drawings in which:

FIG. 16 explains the printed result by the method of driving in the above arrangement;

FIG. 17 explains the printed result by the method of driving in the above arrangement;

DETAILED DESCRIPTION OF THE PREFERRED EMBODIMENTS

The present invention will be described next with reference to the drawings.

Figure 1:
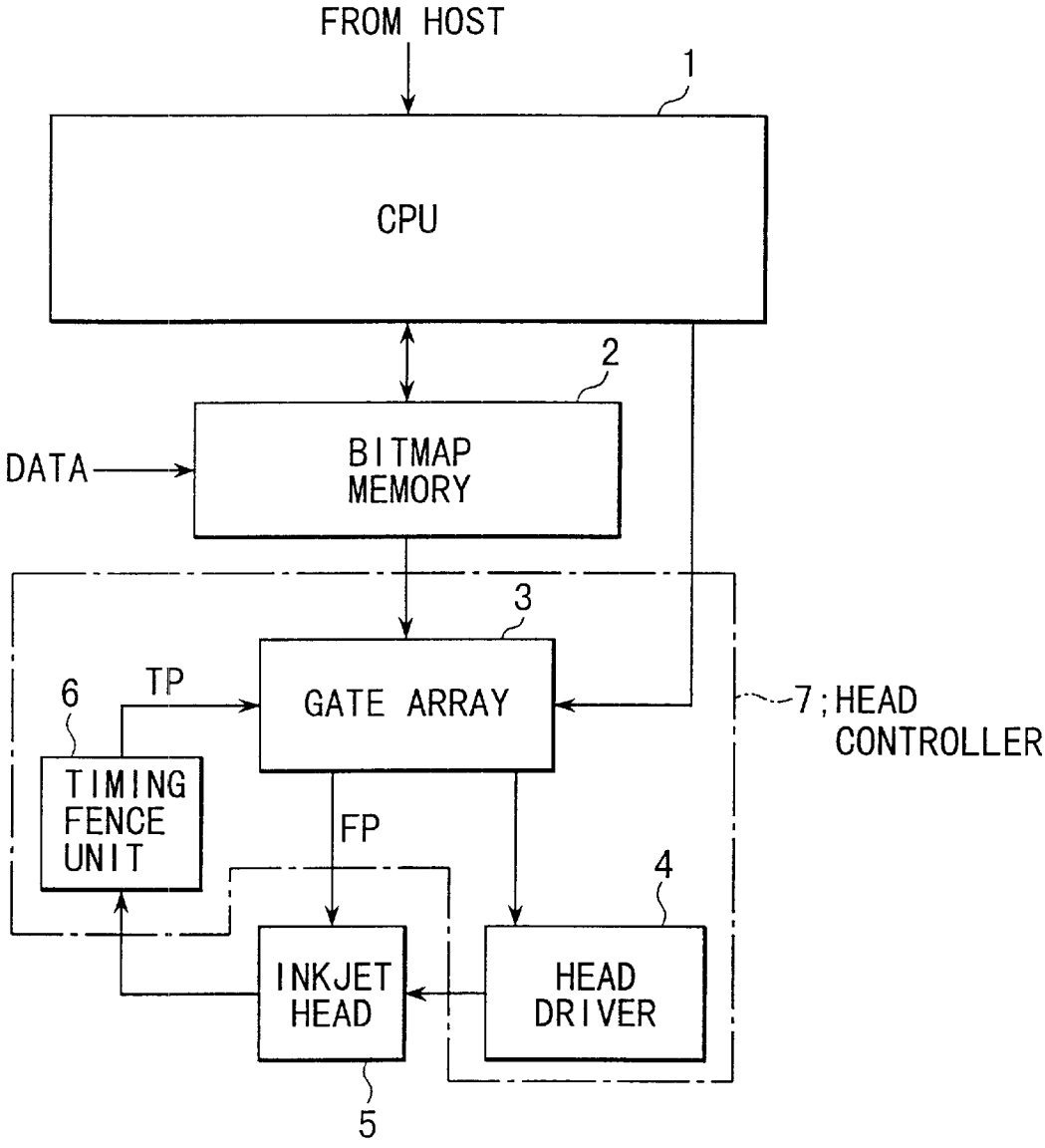
FIG. 1 is a block diagram showing a partial configuration of an inkjet printer according to an embodiment of the present invention.

FIG. 1 is a block diagram showing a partial configuration of an inkjet printer according to an embodiment of the present invention.

Image data to be printed out, such as TIFF, JPEG, MR, MMR and CALS, sent from the non-depicted host system is supplied to a CPU 1. The CPU 1 converts the input image data into bitmap data through decoding, color converting and tone processing, and stores the result in a bitmap memory 2. The bitmap data stored in the bitmap memory 2 is printed out onto a non-depicted print paper by an inkjet head 5 that is driven under control of a head controller 7. The head controller 7 comprises a gate array 3, a head driver 4 and a timing fence unit 6. The gate array 3 outputs timing signals for driving the head, to the head driver 4. The head driver 4 drives the inkjet head 5 in a direction across the print paper (the main scan direction) and also drives the print paper in a direction perpendicular to the main scan direction (the sub scan direction) based on the timing signals. The timing fence unit 6 includes a linear encoder to detect a position of the inkjet head 5 and outputs a timing fence signal TP to the gate array 3 when the inkjet head 5 travels every certain distance in the main scan direction. The gate array 3 outputs the timing signals to the head driver 4 based on the timing fence signal TP. The gate array 3 also outputs firing pulses FP for determining ink firing timings, to the inkjet head 5 based on the timing fence signal TP.

Figure 2:
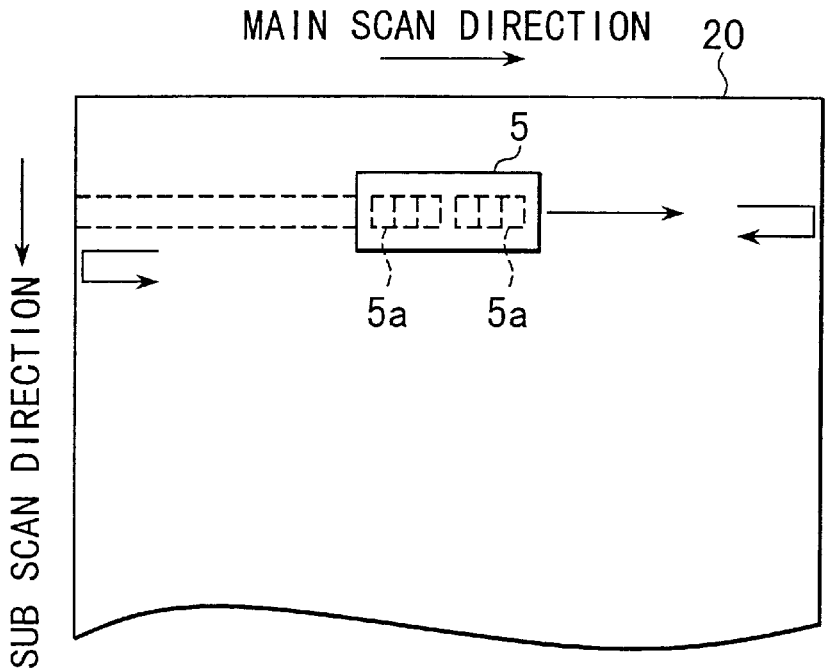
FIG. 2 illustrates motions of the inkjet head relative to a print paper in the above printer.

FIG. 2 illustrates motions of the inkjet head 5 relative to a print paper 20.

Figure 3:
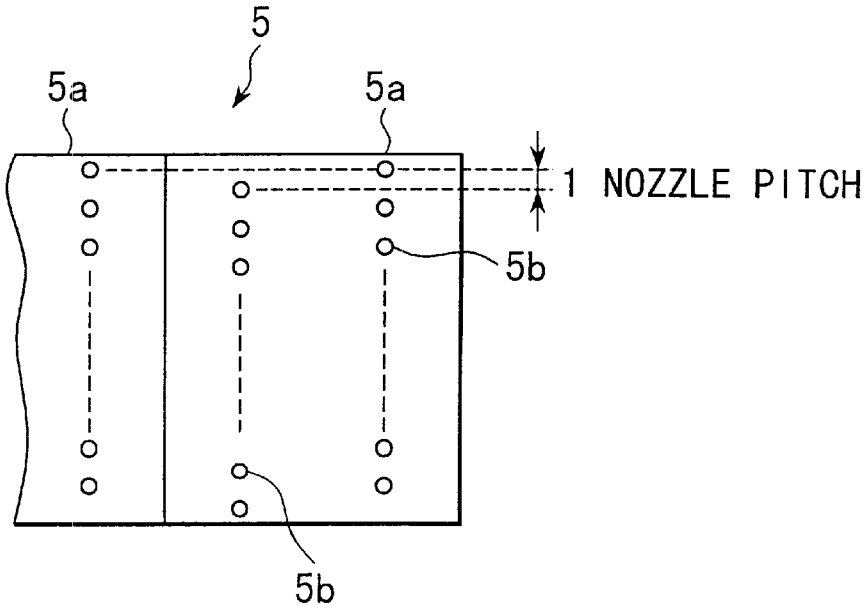
FIG. 3 exemplifies an arrangement of nozzles of the inkjet head in the above printer.

The inkjet head 5 is driven forward and reverse in the main scan direction on the print paper 20. The print paper 20 is driven in the sub scan direction at each end of forward and reverse operations of the inkjet head 5. The inkjet head 5 consists of a plurality of head-segments 5*a* arrayed in the main scan direction for firing different color inks. Each head-segment 5*a* consists of a plurality of nozzles 5*b* for firing the same color inks as shown in FIG. 3. Although these nozzles 5*b* can be arranged in an array along the sub scan direction, they are located in such a zigzag manner that every nozzle alternates its position in the main scan direction as depicted for the convenience of arrangement of the nozzles.

FIG. 4 exemplifies a first arrangement of the inkjet head 5 and method of driving it in the above printer.

Figure 4A:
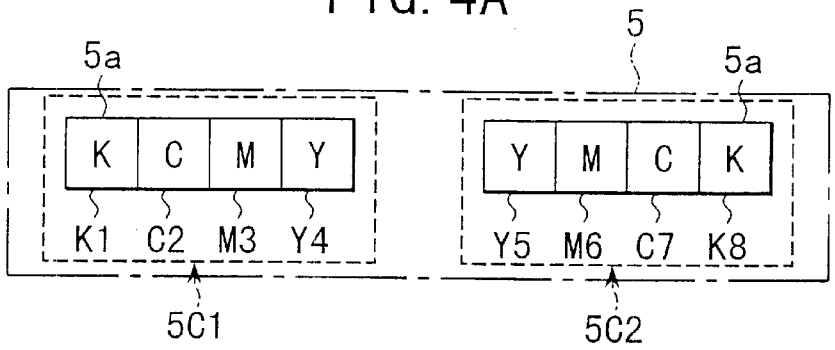
FIGS. 4A and 4B exemplify a first arrangement of the inkjet head and method of driving the same in the above printer.
Figure 4B:
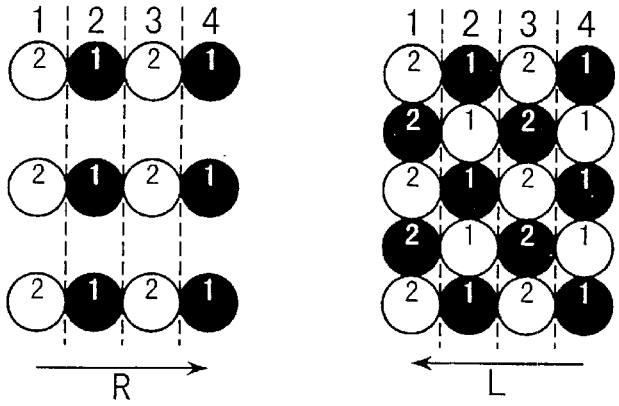

The inkjet head 5 comprises two sets of head-segment groups 5C1 and 5C2 arrayed in the main scan direction as shown in FIG. 4A. One head-segment group 5C1 includes four head-segments 5*a* (K1, C2, M3, Y4) for firing KCMY color inks, respectively. The other head-segment group 5C2 includes four head-segments 5*a* (Y5, M6, C7, K8) for firing YMCK color inks, respectively. Each head-segment 5*a* can be driven independently. The head-segment groups 5C1 and 5C2 may respectively be composed of a four-color composite head that includes four head-segments 5*a*. In FIG. 4B, the numeral 1 contained inside a dot indicates that the dot is formed by the head-segment group 5C1 and the numeral 2 contained inside a dot indicates that the dot is formed by the head-segment group 5C2.

Figure 5:
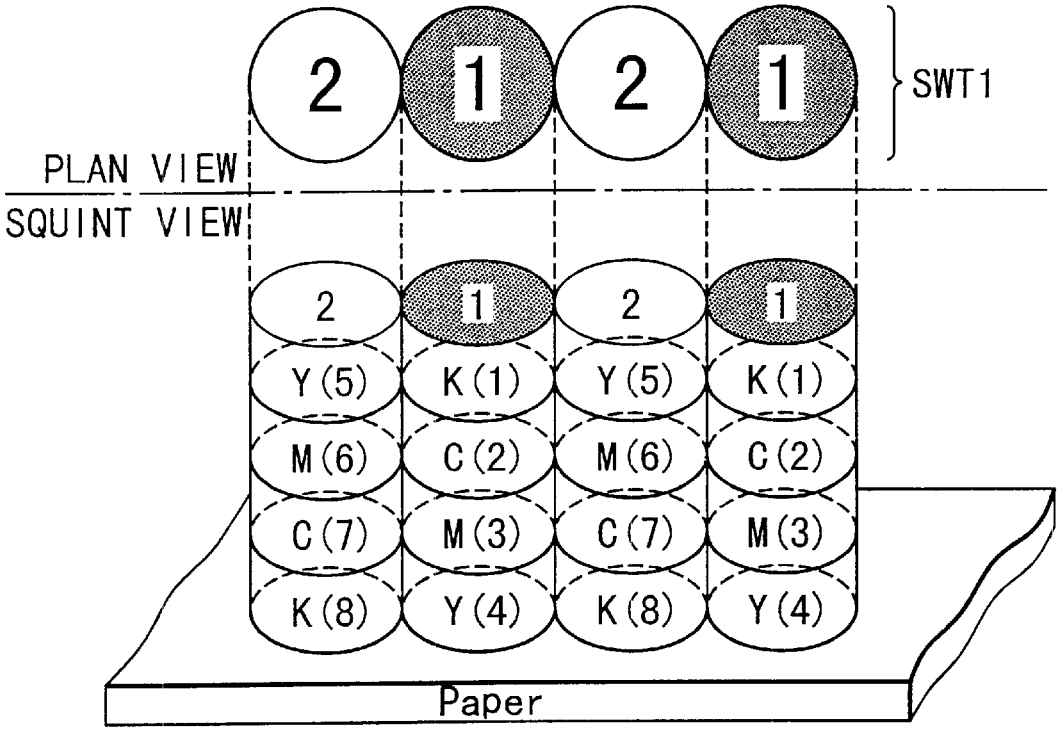
FIG. 5 shows a bright color dot and dark color dot arranged in turn on every adjacent dot location by the method of driving.

The inkjet head 5 would form dots on every other dot location in the sub scan direction per print scan in the main scan direction. When the inkjet head 5 travels in a direction shown with an arrow R (a left-to-right movement: hereinafter referred to as an R-pass) as shown in FIG. 4B, the head-segments K8, C7, M6 and Y5 of the segment group 5C2 form dots on odd columns. The head-segments Y4, M3, C2 and K1 of the segment group 5C1 also form dots on even columns. As a result, bright color dots (dots 2) with inks overlapped in an order of KCMY appear in an array of dots in an odd column (an array of vertically arranged dots sandwiched between dashed lines in the figure). Dark color dots (dots 1) with inks overlapped in an order of YMCK also appear in an array of dots in an even column. In the R-pass, repeating the above operation can arrange the bright and dark color dots alternately. The degree of overlapped color dots in this method is such that ink-overlapping orders in adjacent dots are inverted from each other as shown in FIG. 5. Thus alternately arranged bright and dark color dots can achieve chromatic averaging in adjacent dots.

When the inkjet head 5 travels in a direction shown with an arrow L (a right-to-left movement: hereinafter referred to as an L-pass), as shown in FIG. 4B, the head-segments K1, C2, M3 and Y4 of the segment group 5C1 form dots on even columns. The head-segments Y5, M6, C7 and K8 of the segment group 5C2 also form dots on odd columns. As a result, bright color dots (dots 1) with inks overlapped in an order of KCMY appear in an array of dots in the even column. Dark color dots (dots 2) with inks overlapped in an order of YMCK also appear in an array of dots in the odd column. Thereafter, similarly repeating firing inks as above can arrange the bright and dark color dots alternately.

Thus, swaths with inverted color overlapping orders in the R-pass/L-pass are made. Finally, plural swaths configured with these combinations are generated and overlapped to complete a printed image. As a result, such a chromatic averaging effect to the whole swath can be obtained, as to create a "checker board" pattern of low and high-density segments which are evenly distributed and, therefore, not detectable to the human observer.

In a system designed to print with a 720 dpi horizontal resolution, this method would require each head segment 5*a* to print with a firing rate equivalent to 720 dpi, but with a head transport speed (HTS) double what would normally be required of a single inkjet head printing at such a resolution. For example, assuming an 8 kHz firing rate, the head transport speed would be calculated in the following manner:

$$\left(\frac{8000_{Hertz}}{720_{dpi}}\right) = 11.1_{ips} \times 2_{Array} = 22.2_{ips}$$

Figure 6:
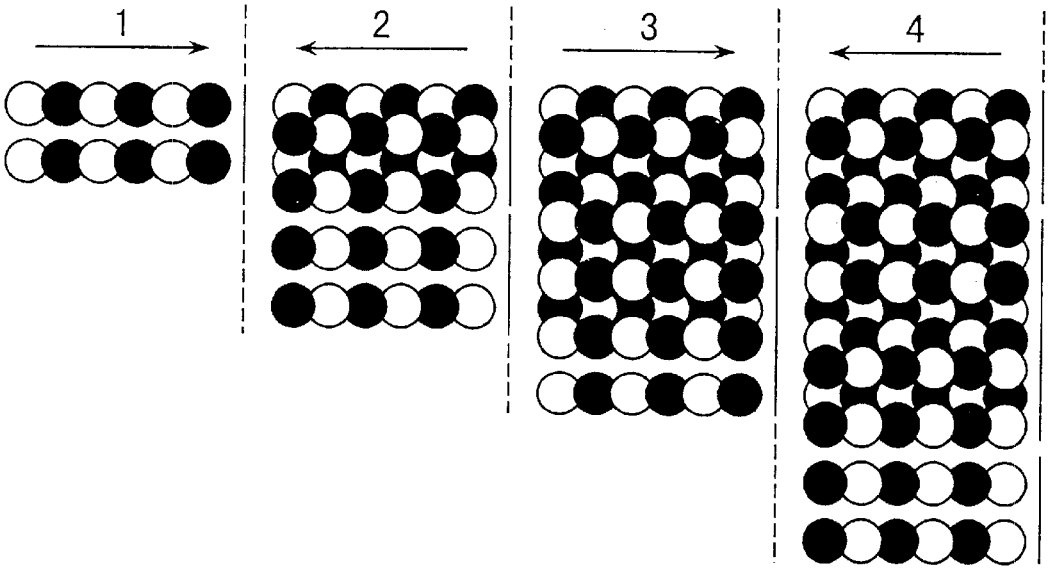
FIG. 6 shows an arrangement after considering the print result by the method of driving.

Taking into account dot gain, as described previously, the dot pattern produced by this method would look like patterns as shown in FIG. 6. When the inkjet head 5 travels from left to right (as shown with an arrow 1), a right side dot overlaps a left side dot due to dot gain. When the inkjet head 5 travels from right to left (as shown with an arrow 2), a left side dot overlaps a right side dot and, at the same time, overlaps a row of dots previously formed in the main scan direction due to dot gain. Since the bright and dark dots are arranged alternately in the main scan direction, however, the bright and dark dots can be evenly distributed to prevent chromatic variation in adjacent swaths regardless of the inkjet head 5 that travels on either directional pass. In this embodiment, the ink arrangements in the segment groups of the inkjet head 5 may also be configured in such the opposite manner as an order of YMCK for the segment group 5C1 and an order of KCMY for the segment group 5C2 in order to obtain the same chromatic averaging effect.

Figure 7A:
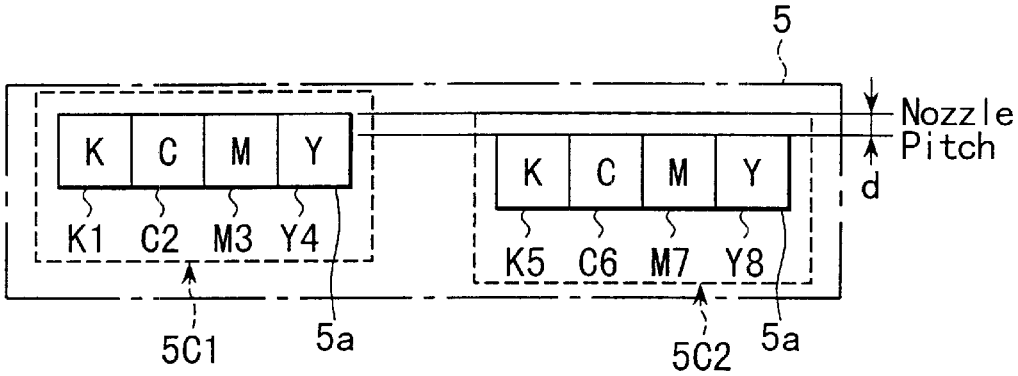
FIG. 7A exemplifies a second arrangement of the inkjet head in the above printer.
Figure 7B:
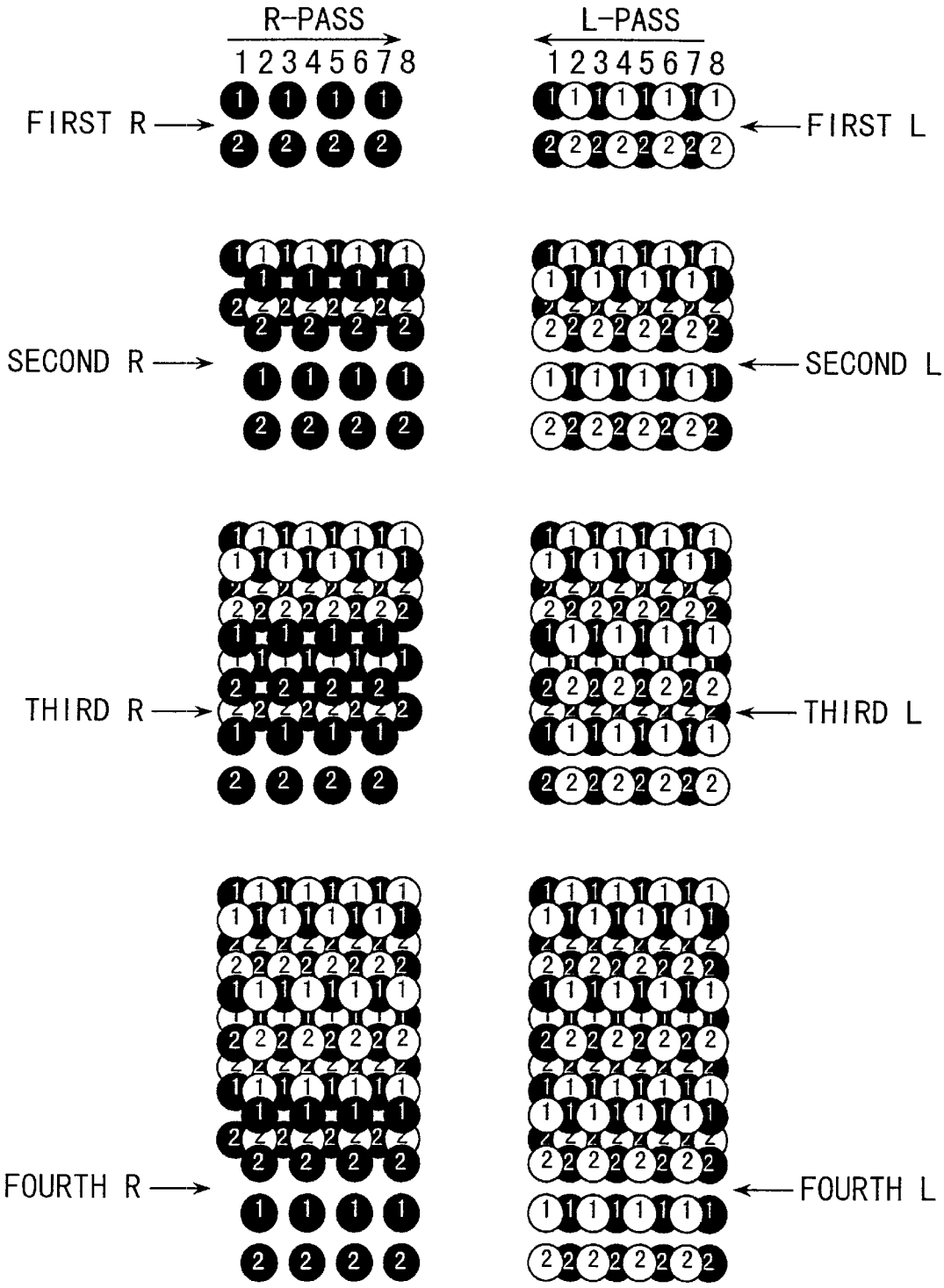
FIG. 7B shows the method of driving the same.

FIGS. 7A and 7B exemplifies a second arrangement of the inkjet head and method of driving it in the above printer.

As shown in FIG. 7A, this inkjet head 5 is configured to offset one segment group 5C2 to the other segment group 5C1 by a distance d equivalent to a head segment gap or one nozzle pitch in the sub scan direction. The segment group 5C1 includes four head-segments 5*a* (K1, C2, M3, Y4) for firing KCMY color inks. The other segment group 5C2 also includes four head-segments 5*a* (K5, C6, M7, Y8) for firing KCMY color inks. Each head segment 5*a* can be driven independently. The segment groups 5C1 and 5C2 are assumed to have separate drive channels similar to the first arrangement. The segment groups 5C1 and 5C2 may also be four-color composite heads each having four head segments 5*a*.

As shown in FIG. 7B, the inkjet head 5 would form dots on every other dot location in the sub scan direction per print scan in the main scan direction. When the inkjet head 5 travels on a first R-pass, the head-segments Y4, M3, C2 and K1 of the segment group 5C1 and the head-segments Y8, M7, C6 and K5 of the segment group 5C2 form dots on odd columns. As a result, dark color dots with inks overlapped in an order of YMCK are formed alternately in both the main and sub scan directions in an array of dots in the odd column.

When the inkjet head 5 travels on a first L-pass, the head-segments K1, C2, M3 and Y4 of the segment group 5C1 and the head-segments K5, C6, M7 and Y8 of the segment group 5C2 form dots on even columns. As a result, bright color dots with inks overlapped in an order of KCMY are formed alternately in both the main and sub scan directions in an array of dots in the even column.

When the inkjet head 5 travels on a second R-pass, the head-segments Y4&8, M3&7, C2&6 and K1&5 of the segment groups 5C1 and 5C2 form dots on even columns so that dark color dots with inks overlapped in the order of YMCK are formed alternately in both the main and sub scan directions in this dot array.

When the inkjet head 5 travels on a second L-pass, the head-segments K1&5, C2&6, M3&7, and Y4&8 of the segment groups 5C1 and 5C2 form dots on odd columns so that bright color dots with inks overlapped in the order of KCMY are formed alternately in both the main and sub scan directions in this dot array.

When the inkjet head 5 travels on a third R-pass, each head-segment of the segment groups 5C1 and 5C2 forms dark dots on odd columns. When the inkjet head 5 travels on a third L-pass, each head-segment of the segment groups 5C1 and 5C2 forms bright dots on even columns. When the inkjet head 5 travels on a fourth R-pass, each head-segment of the segment groups 5C1 and 5C2 forms dark dots on even columns. When the inkjet head 5 travels on a fourth L-pass, each head-segment of the segment groups 5C1 and 5C2 forms bright dots on odd columns. These operations are repeated to complete printing.

This method can greatly effect when two composite inkjet heads each having four independent head-segments are applied to an inkjet printer. A segment group in a common inkjet printer mostly has as many nozzles of K head-segment as twice the number of C, M and Y head-segments in order to improve monochrome (K only) print performance. To achieve a high-speed monochrome print, firing pulses are alternately applied to two K head-segments. In this configuration, however, positions to fire K ink are inevitably determined. Therefore, it is not possible to arrange the head-segments 5*a* in an inverted relation as in KCMY and YMCK orders similar to the first arrangement. Accordingly, in this embodiment, the head-segments 5*a* are arranged in the same manner as KCMY and KCMY orders. Two segment groups are offset to each other by nozzle gaps of C, M and Y in the sub scan direction.

In this arrangement, both the segment groups 5C1 and 5C2 form dark dots in an ink overlapping order of YMCK on the R-pass. The L-pass by both the segment groups 5C1 and 5C2 also form bright dots in an ink overlapping order of KCMY. In addition, the inkjet head 5 alternates positions for forming dark dots and positions for forming bright dots in the odd columns and even columns per scan (forward and reverse transportation) to form a "checker board" pattern as shown in FIG. 7B. Thus, the effect of averaging chromatic variations in the printed result can be obtained by distributing different color dots evenly.

Figure 8A:
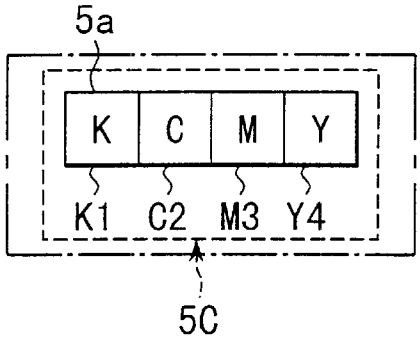
FIG. 8A exemplifies a third arrangement of the inkjet head in the above printer.

A third arrangement derived from the second arrangement is shown in FIG. 8A, which employs a segment group 5C consisting of four head-segments 5*a* (for example, K1, C2, M3, Y4) for respectively firing KCMY (or YMCK) color inks or a composite inkjet head consisting of four independent head-segments 5*a* (for example, Y4, M3, C2, K1) as the inkjet head 5. This arrangement differs from the second arrangement in that only one set of segment group 5C is employed instead of two sets of segment groups 5C1 and 5C2. This arrangement requires such dot gain as to average chromatic variations in both the main and sub scan directions. Therefore, the print performance itself of this embodiment is simply reduced to half that of the second embodiment in order to obtain the same effect. However, similar to the above, duplicating the number of K nozzles relative to that of CMY nozzles can achieve a high-speed monochrome print. In addition, the cost and the complexity of designs for head-segments and segment groups can also be reduced.

Another effect in printing by this arrangement is that an HTS derived from an ink firing frequency and a resolution in the sub scan direction is sufficient to be half a resolution required for each print pass and thus it can be doubled.

Figure 8B:
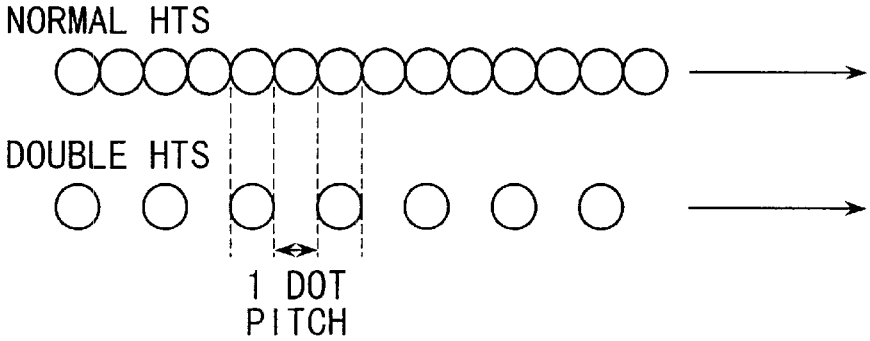
FIG. 8B shows a method of driving the inkjet head.

FIG. 8B shows a method of driving the inkjet head 5 in FIG. 8A.

As shown in FIG. 8B, firing pulses at the double HTS according to this method of driving are set to fire one dot per two dots in the main scan direction compared to firing pulses at the normal HTS, leaving alternate gaps between dots, each equal to a diameter of a single dot. Double print passes are necessary in this method compared to that for completing one print swath by the normal passes but the print operation in this method can be performed at the double HTS. Therefore, the total print time to complete each swath is almost equal to that by printing at the normal HTS.

The key to eliminating chromatic variation in this method is to offset every other print swath in the sub scan direction by one pixel in the main scan direction. To understand the overall result of printing in this method, it is necessary to illustrate how dot gain impacts the overall density variations within the printed image.

Figure 9:
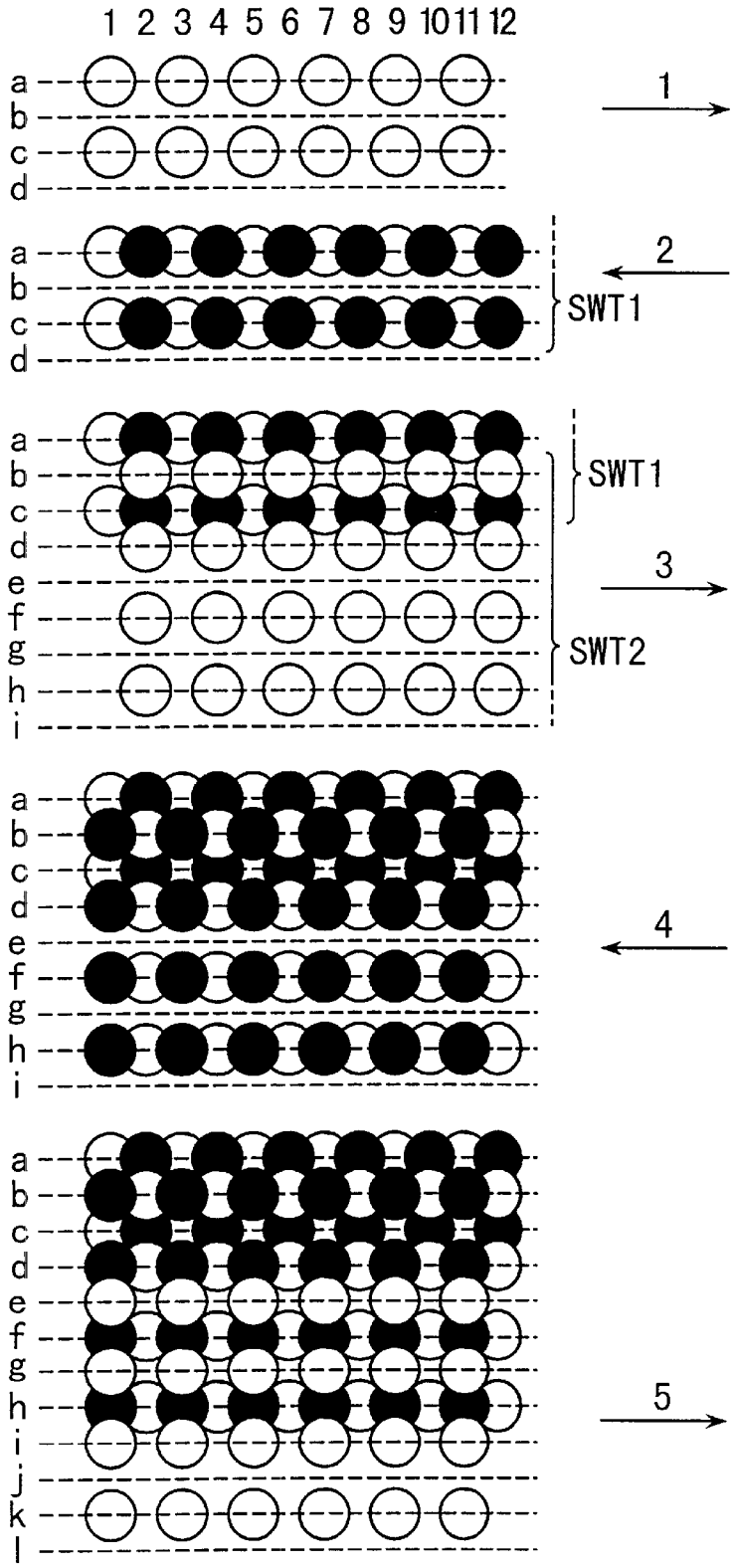
FIG. 9 explains dot gain effecting on chromatic variation in a printing process by the above printer.

FIG. 9 explains dot gain effecting on chromatic variation in a printing process. In this case, the segment group comprises four head-segments of KCMY.

As shown in FIG. 9, in the first pass (shown with an arrow 1), the segment group of the inkjet head 5 passes over the scan lines a and c, printing every dot in all odd number columns with bright color inks in KCMY overlapping order. The segment group begins firing in #1 column. Dots in even number columns are not printed, because HTS is 2×normal speed.

In the second pass (shown with an arrow 2), the segment group passes, printing every dot in even number columns, which is located between dots formed by the first pass, with dark color inks in YMCK overlapping order. The segment group begins firing in #12 column. Therefore, the swath SWT 1 with a resolution of 360×180 dpi is produced so far, but in 2×print passes.

In the third pass (shown with an arrow 3), the inkjet head 5 shifts one dot pitch in the sub scan direction and prints every dot in even number columns with bright color inks in KCMY overlapping order, beginning with #2 column. This has the effect of shifting every other print swath in the sub scan direction by one pixel in the main direction, so that the bright color dots overlap the dark color dots along the sub scan direction (to prevent vertical banding).

In the fourth pass (shown with an arrow 4), the segment group prints in a manner similar to the second pass, beginning to fire inks in odd columns not to overlap dots previously printed in even columns. This has the effect of producing a "checker board" pattern as described above.

In the fifth pass (shown with an arrow 5), the segment group prints dots in odd number columns similar to the first pass. By repeating this offset on every other print swath in the sub scan direction, high and low-density dots will overlap on both the main and sub scan directions, effectively eliminating the chromatic variation that leads to "banding".

According to this method of driving, the effect for chromatic averaging can also be achieved similar to those by the first and second methods of driving. This requires, however, a different condition that print-beginning positions in adjacent swaths must be shifted by a diameter of a dot as described above. For example, it is necessary to repeat such operations as beginning to print dots in odd number columns in the scan lines a and c on the first pass, beginning to print dots in even number columns in the scan lines b, d, f and h on the third pass, and beginning again to print dots in odd number columns (in the scan lines e and g) on the fifth pass, even though these passes belong to the same R-passes.

This method, unlike all previous methods, can be retrofitted to most existing inkjet printers, without requiring mechanical modification to the print engine. Therefore, the print head configuration and shape can remain intact, preventing the production cost for the inkjet printer from increasing. Only the firmware must be updated to accommodate this method of chromatic averaging. In addition, to actually achieve a performance increase over unidirectional mode, this method requires a printer capable 2×HTS.

Figure 10A:
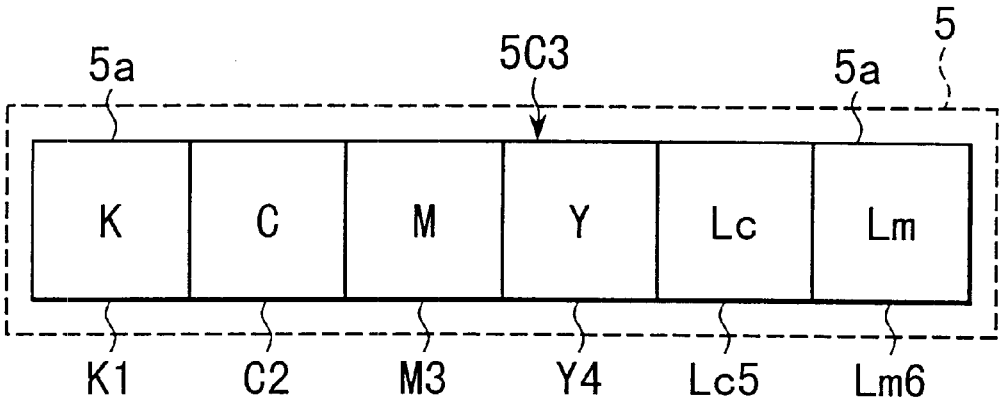
FIGS. 10A and 10B show another arrangement applicable for a third method of driving the inkjet head in the above printer.
Figure 10B:
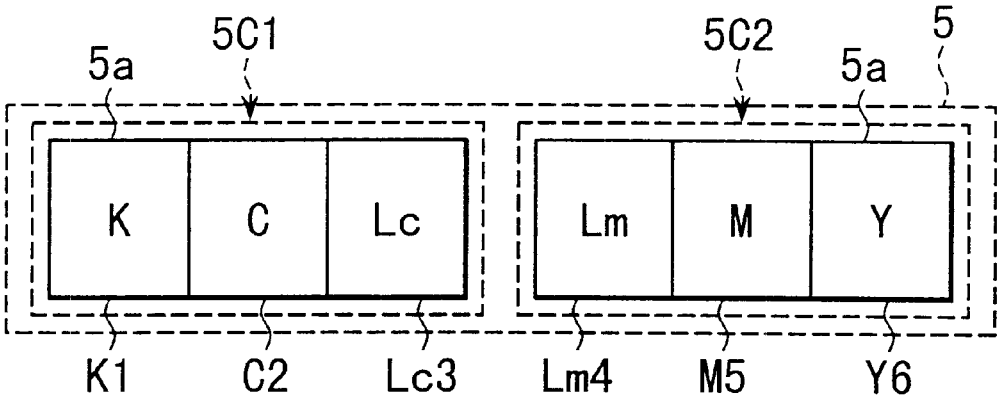

This method of driving may be applied to such an inkjet head 5 as shown in FIG. 10A, which includes a composite segment group 5C3 having six head-segments 5*a* (K1, C2, M3, Y4, Lc5, Lc6) arranged inline. It may also be applied to such an inkjet head 5 as shown in FIG. 10B, which includes two composite segment groups having a segment group 5C1 consisting of three head segments 5*a* (K1, C2, Lc3) and a segment group 5C2 consisting of three head segments 5*a* (Lm4, M5, Y6). A six-color mechanism using CMYK with additional colors, such as lighter cyan (Lc), lighter magenta (Lm) and lighter black (Lk), or with spot colors of red, green, blue and orange, is applicable for expanded gamut printing. In this case, 2×HTS is required for printing every other dot on every print pass in the main scan direction. In addition, adjacent swaths must be begun to print, being shifted in the main scan direction by a diameter of a dot, so that bright and dark color dots are distributed in a "checker board" pattern on the final printed result. This method has an advantage that the conventional inkjet printers capable of 2×HTS can be improved without modification to the mechanical design of the print engine or ink delivery system.

FIG. 11 shows a fourth arrangement of the inkjet head 5 and method of driving it in the above printer.

Figure 11A:
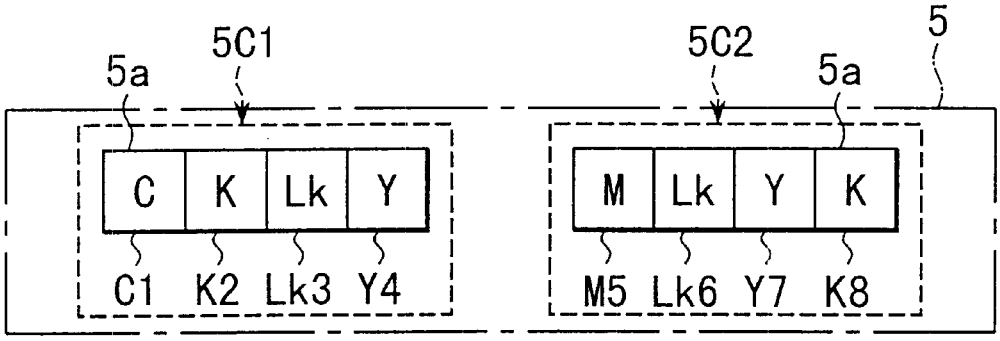
FIGS. 11A and 11B show a fourth arrangement of the inkjet head and method of driving it in the above printer.

As shown in FIG. 11A, the inkjet head 5 comprises two sets of segment groups 5C1 and 5C2. One segment group 5C1 includes four head-segments 5*a* (C1, K2, Lk3, Y4) for firing CKLkY color inks. The other segment group 5C2 includes four head-segments 5*a* (M5, Lk6, Y7, K8) for firing MLkYK color inks. The inkjet head 5 comprises eight head-segments 5*a* for five colors in total. The segment groups 5C1 and 5C2 are controlled individually through two separate drive channels. The head-segment 5*a* (C1 and M5) consists of nozzles (additional nozzles) twice the number of nozzles mounted on other head-segments (K2, Lk3, Y4, Lk6, Y7, K8), and ½ the nozzle gap. Firing pulses are applied alternately to the segment groups 5C1 and 5C2 so that one segment group 5C1 prints dots in odd number columns while the other segment group 5C2 prints even number columns, alternating between print swaths. In this method, the head-segments 5*a* in the two sets of segment groups 5C1 and 5C2 have different ink orders and colors, and thus can generate four, not two, brightness dots. The key to this method of printing is to average the chromatic error, generated from bidirectional printing, using a quadrilateral algorithm, interweaving the four densities into a "checker board" pattern and thus eliminating any observable artifact. In addition, this method can generate one full swath consisting of dots colored cyan (C) and magenta (M) for each ½-resolution of swath consisting of dots generated by the head-segments 5*a* (K2, Lk3, Y4, Lk6, Y7, K8) for other colors by providing additional nozzles to the head-segment 5*a* (C1 and M5) as described above. By doing so, image quality can be further enhanced through the use of low-density K (Lk), effectively improving contrast control; the effect is to enhance the "pop" of the image.

Figure 11B:
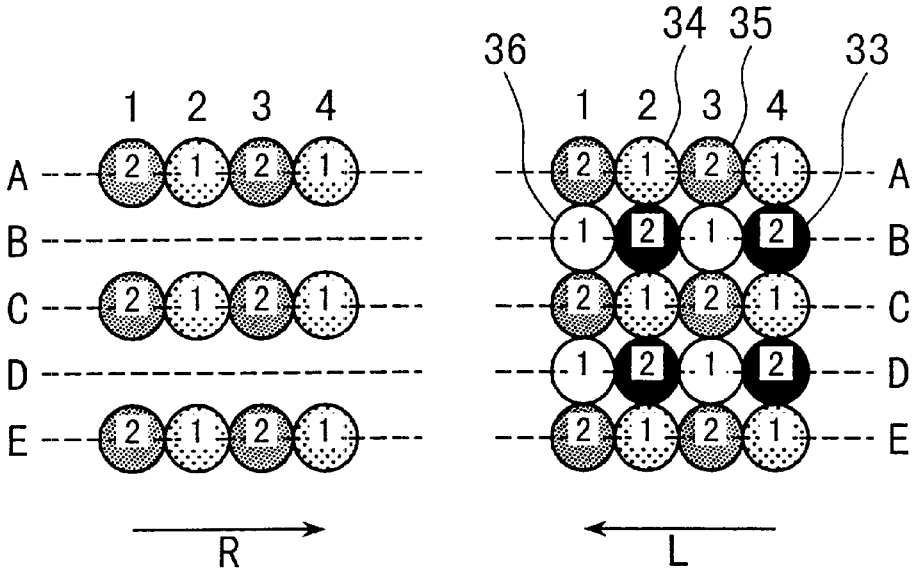
Figure 12:
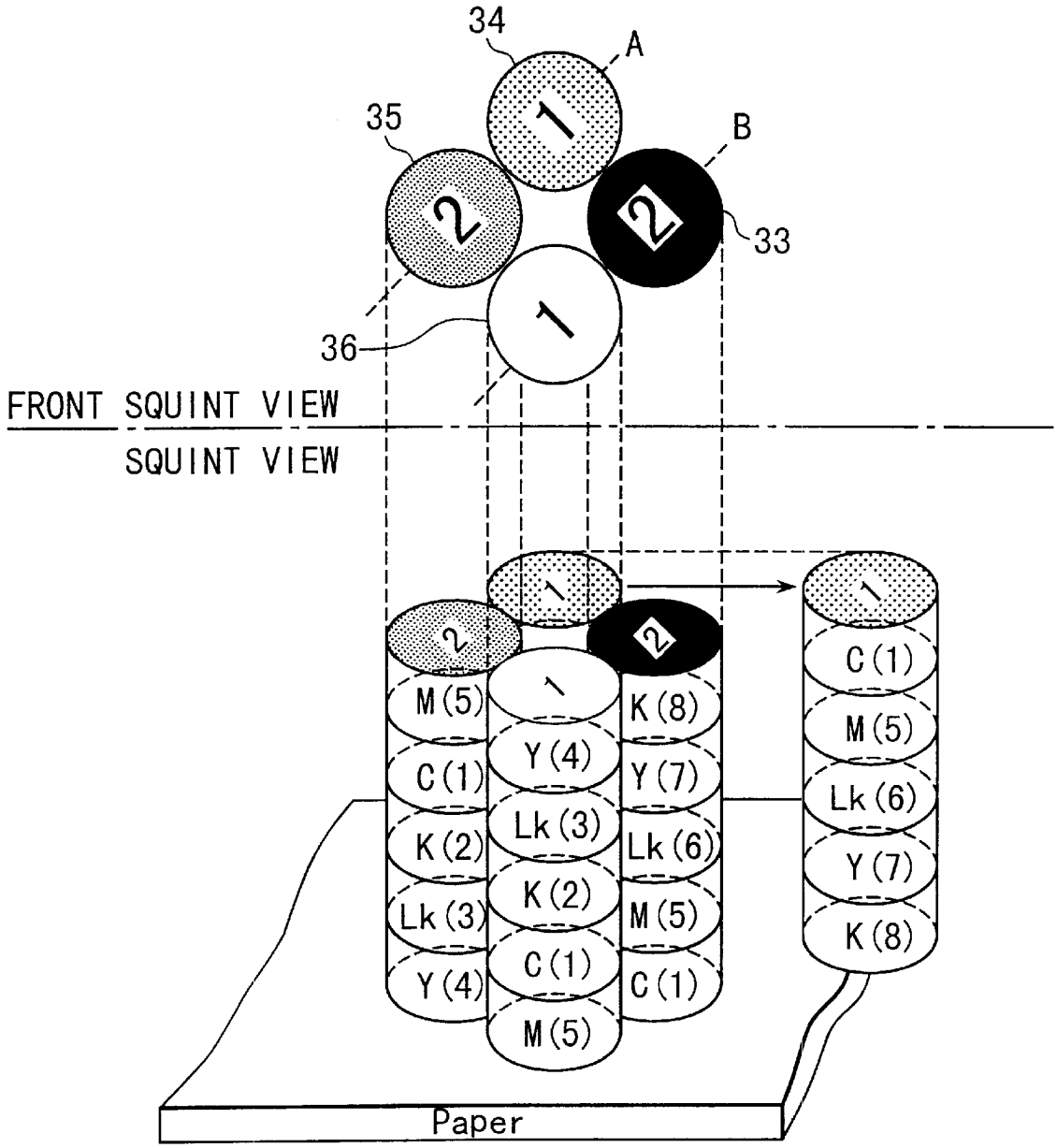
FIG. 12 shows bright color dots and dark color dots arranged in turn on every adjacent in turn on every adjacent dot location by the method of driving.

Printing by this method can generate four different brightness dots 33, 34, 35 and 36, which have respectively different ink color overlapping orders of CMLkYK, KYLkMC, YLkKCM and MCKLkY as shown in FIG. 12, in a rectangular arrangement. When the inkjet head 5 travels on an R-pass as shown in FIG. 11B, the segment groups 5C1 and 5C2 form the mid-bright dots 35 (dots 2) on odd number columns in scan lines A, C and E, on every other dot gap in the main scan direction, with an ink order fired from the head-segments 5*a* (Y4, Lk3, K2, C1, M5). At the same time, they form the mid-bright dots 34 (dots 1) on even number columns in the same scan lines, on every the same gap in the same scan direction, with an ink order fired from the head-segments 5*a* (K8, Y7, Lk6, M5, C1).

When the inkjet head 5 travels on an L-pass next, the segment groups 5C1 and 5C2 form the darkest dots 33 (dots 2) on even number columns in scan lines B and D, on every the same gap, with an ink order fired from the head-segments 5*a* (C1, M5, Lk6, Y7, K8). At the same time, they form the brightest dots 36 (dots 1) on odd number columns in the same scan lines, on every the same gap, with an ink order fired from the head-segments 5*a* (M5, C1, K2, Lk3, Y4). Such the operations can generate a "checker board" pattern and thus average chromatic errors in adjacent swaths.

Both timing and data buffering are critical to this method of printing. The printer firmware must be able to create a unique dot pattern. This unique dot pattern can be created by applying firing pluses alternately to the head-segments 5*a* (C1 and M5) so that they generate dots in the sub scan direction, twice the number of those generated by other head-segments 5*a*, but not create adjacent vertical dot columns on each print swath. This can be illustrated with reference to the drawing.

FIG. 13 explains ink-firing operations of the head-segments 5*a* (C1 and M5) of the inkjet head 5.

Figure 13A:
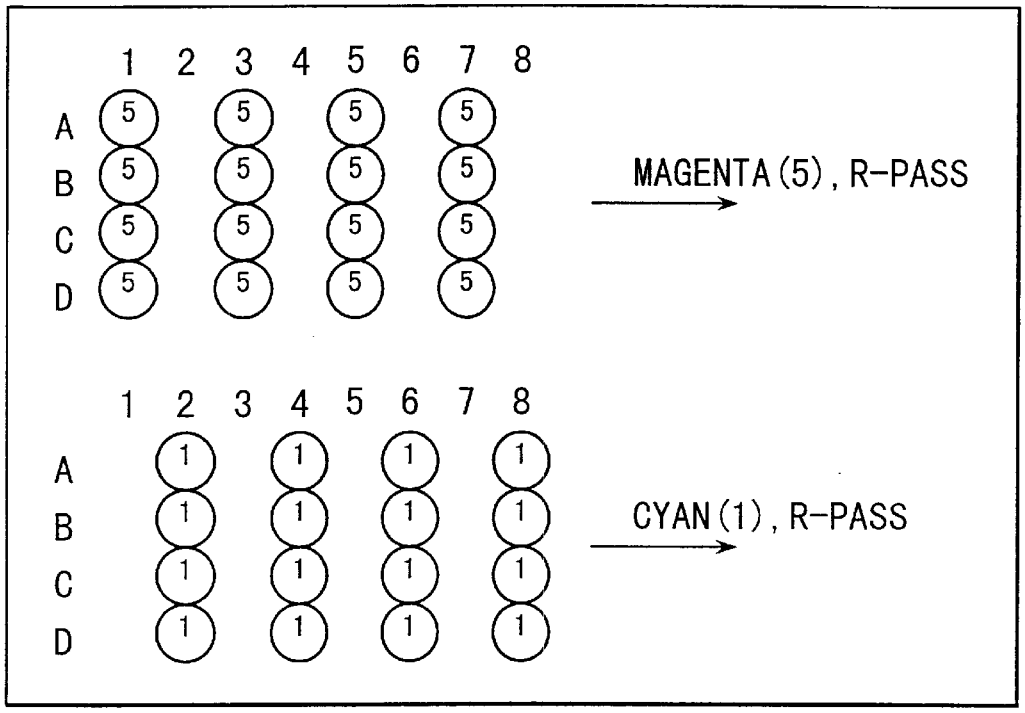
FIGS. 13A and 13B explain ink-firing operations of the head-segments of the inkjet head in the above arrangement.
Figure 13B:
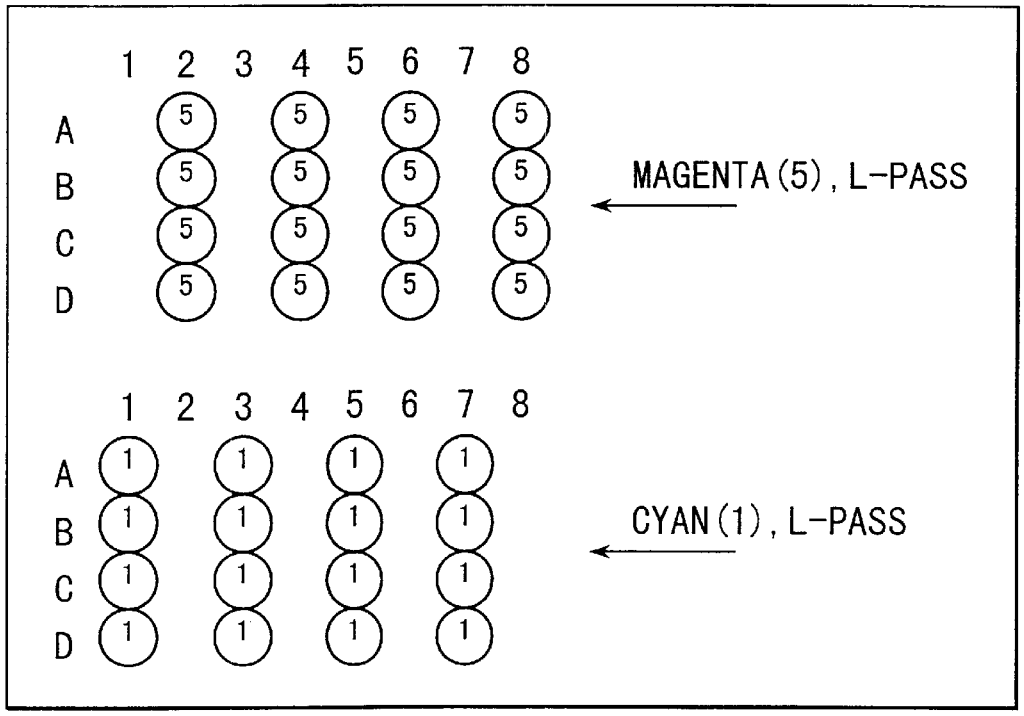

As shown in FIG. 13A, on an R-pass the head-segment 5*a* (M5) fires a magenta color ink to form dots on odd number columns and the head-segment 5*a* (C1) fires a cyan color ink to form dots on even number columns. To the contrary, as shown in FIG. 13B, on an L-pass the head-segment 5*a* (M5) fires the ink to form dots on even number columns and the head-segment 5*a* (C1) fires the ink to form dots on odd number columns. It can be understood from this that the head-segment 5*a* for firing magenta and cyan color inks performs printing by firing inks on every other dot array in the sub scan direction so that the two colors can be alternately combined. It can also be found that one print swath is completed through two print passes. This is essentially different from the method used to print the other color inks. This can be explained using the drawing.

FIG. 14 explains ink-firing operations of the head-segments 5*a* (K2 and K8) of the inkjet head 5.

Figure 14A:
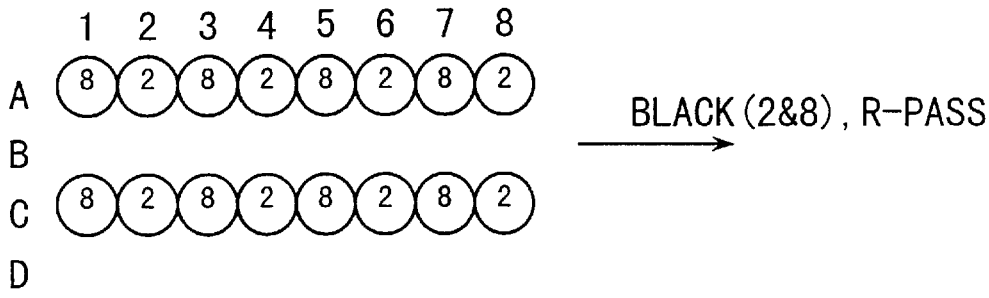
FIGS. 14A and 14B explain ink-firing operations of the head-segments of the inkjet head in the above arrangement.
Figure 14B:
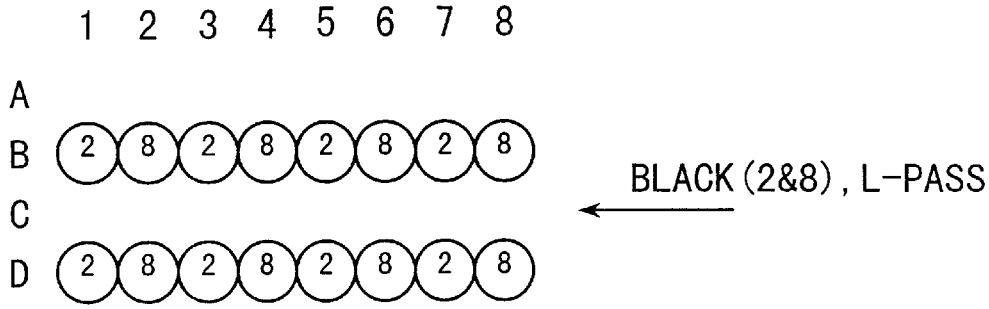

As shown in FIG. 14A, on an R-pass the head-segment 5*a* (K8) fires black ink to form dots on odd number columns in the scan lines A and C and the head-segment 5*a* (K2) fires the same ink to form dots on even number columns. In addition, as shown in FIG. 14B, on an L-pass the head-segment 5*a* (K8) fires the ink to form dots on even number columns and the head-segment 5*a* (K2) fires the ink to form dots on odd number columns. A print swath in this case (as well as a print swath created from Y and Lk) can be completed in forward and reverse passes. Accordingly, this method of driving can improve the image quality and achieve the same performance improvements characteristic of the alternate pulsing approach.

Figure 15:
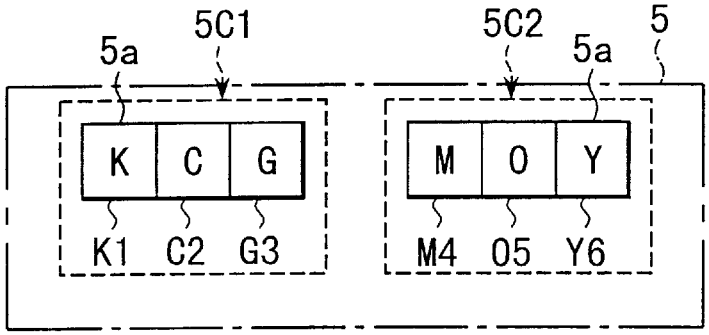
FIG. 15 exemplifies a fifth arrangement of the inkjet head in the above printer.
Figure 18A:
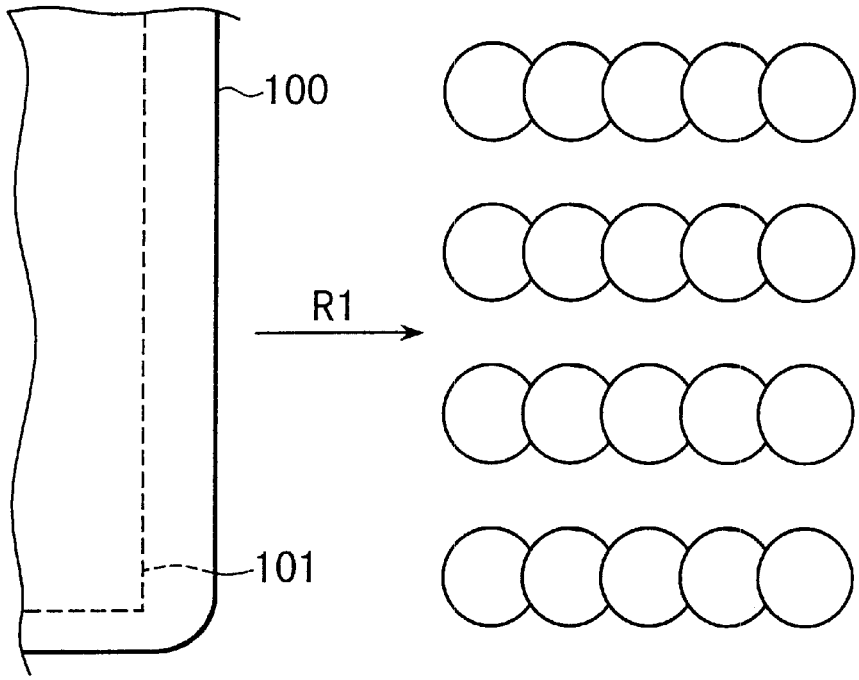
FIG. 18A shows a theoretical model in case of printing in an interleaving mode by the conventional inkjet printer.
Figure 18B:
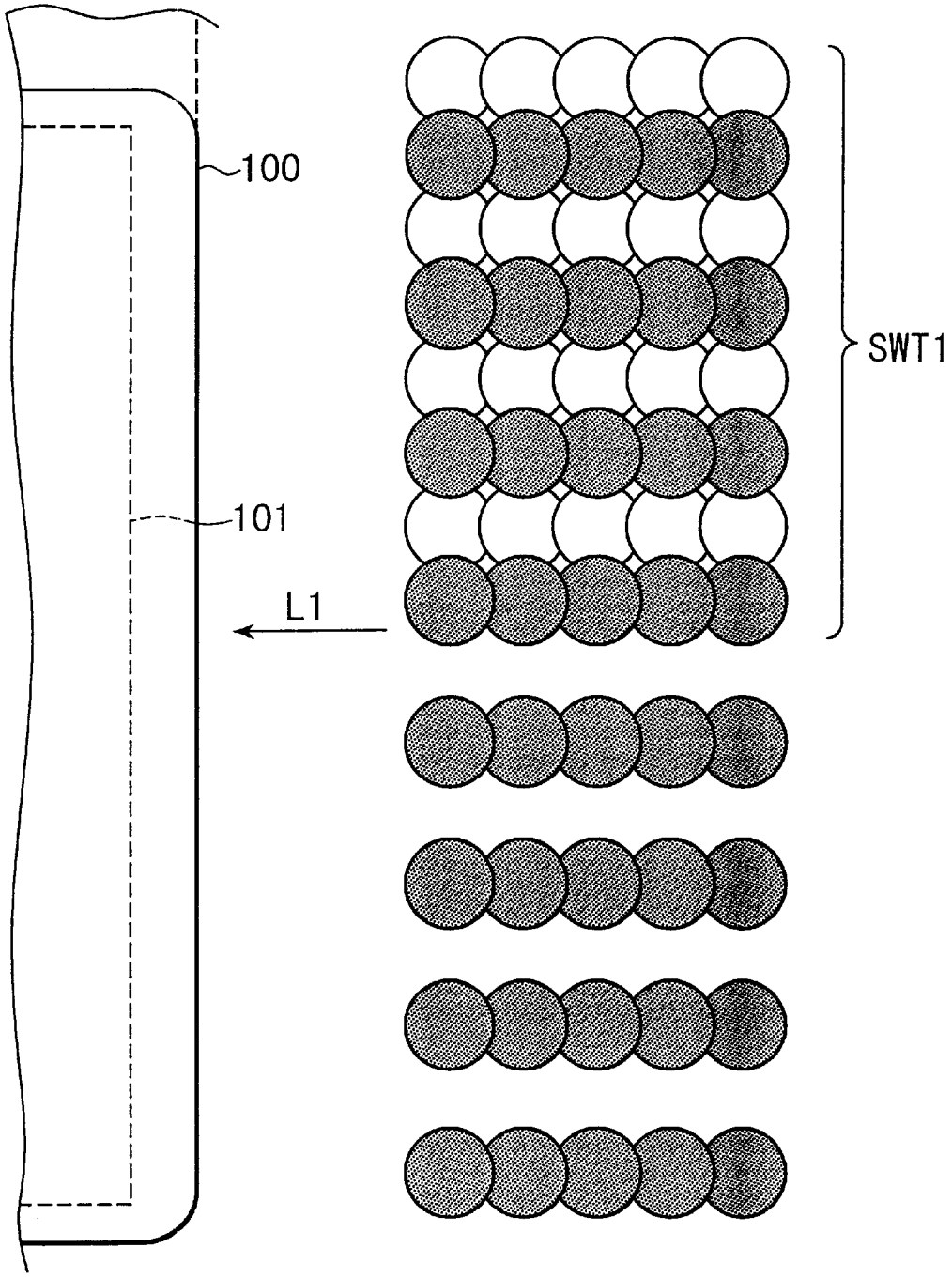
FIG. 18B shows the theoretical model in case of printing in the interleaving mode by the conventional inkjet printer.
Figure 18C:
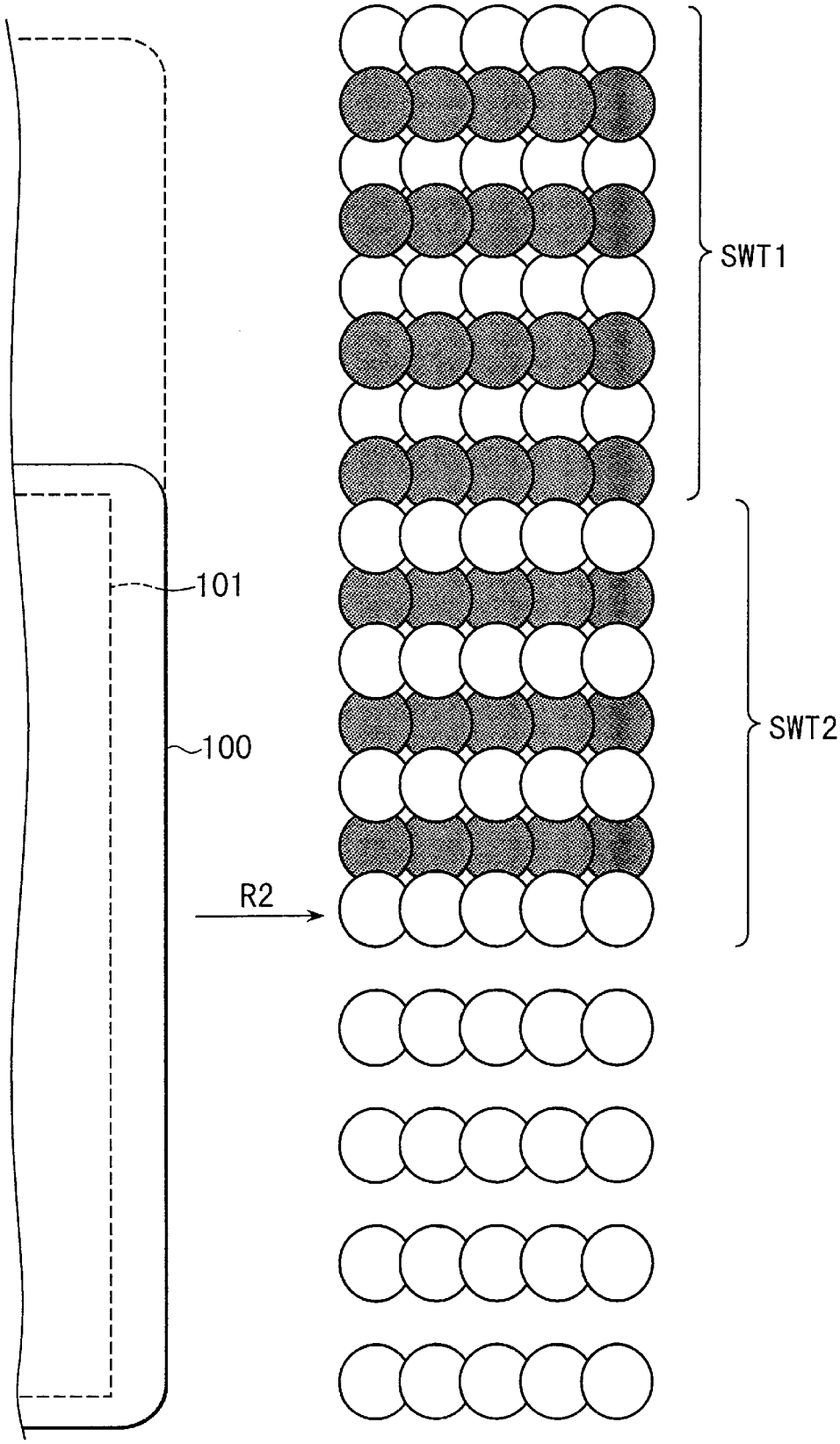
FIG. 18C shows the theoretical model in case of printing in the interleaving mode by the conventional inkjet printer.
Figure 19A:
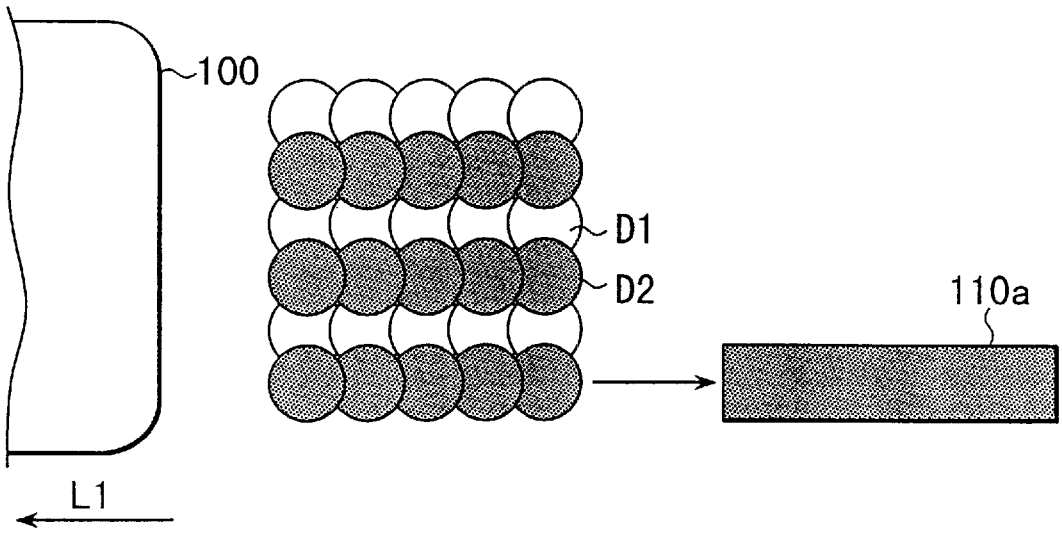
FIG. 19 details dot gain in the theoretical model.
Figure 19B:
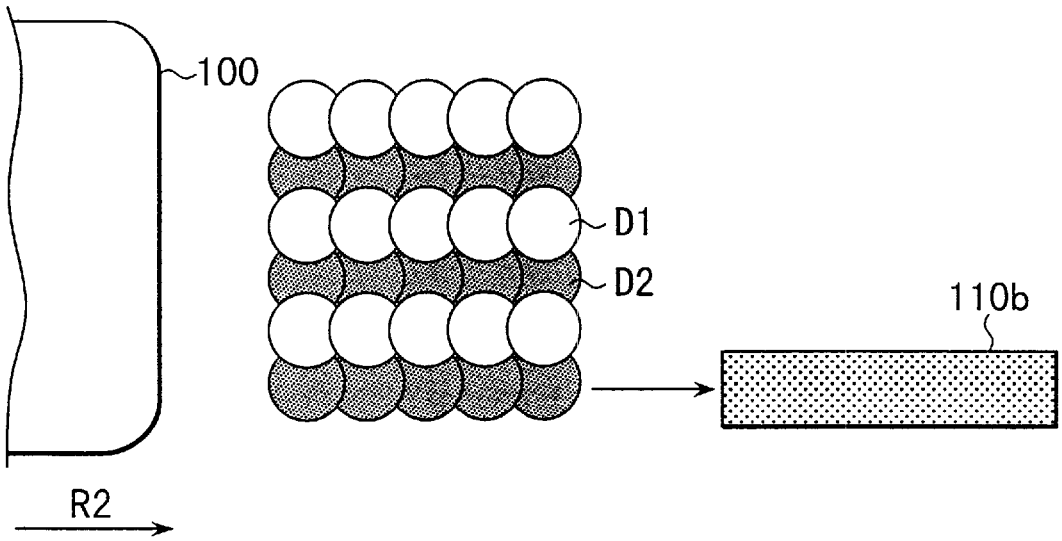

FIG. 15 exemplifies a fifth arrangement of the inkjet head 5, and FIGS. 16 and 17 explain the printed result by a method of driving.

As shown in FIG. 15, the inkjet head 5 comprises six head-segments 5*a* for six colors in total, which are contained in two split segment groups 5C1 and 5C2 arranged inline. The segment group 5C1 includes three head-segments 5*a* (K1, C2, G3) for firing K, C and G (green) color inks and the segment group 5C2 includes three head-segments 5*a* (M4, 05, Y6) for firing M, O (orange) and Y color inks. The segment groups 5C1 and 5C2 are controlled individually trough two separate drive channels, employing the quadrilateral algorithm. In this way, the two segment groups 5C1 and 5C2 can be alternate pulsed so that chromatic averaging is split along both the main and sub scan directions. The effect is the "checker board" pattern as illustrated in the fourth method of driving. According to this method, two segment groups 5C1 and 5C2 can be driven independently. Therefore, this method enables one segment group 5C1 to print dots on odd number columns and the other segment group 5C2 to print dots on even number columns, alternating between print swaths, regardless of the transportation passes of the inkjet head 5. This method has the effect of creating four unique dot densities, similar to that described in the fourth method of driving. But it is different from the fourth method in that the head-segments 5*a* are comprised of six colors instead of five and that all head-segments 5*a* are comprised of the same number of nozzles and with same dot pitch.

An example of a six-color inkjet head 5 of CMYK+OG is shown in FIG. 15. This method would function with any standard combination of process, or process plus spot colors. This inkjet head 5 can print in such a manner as shown in FIG. 16, assuming that proper ink order was derived in advance.

As shown in FIG. 16, to form alternate dots, in the first R-pass, the head-segments 5*a* (Y6, O5, M4) of the segment group 5C2 would fire YOM inks onto dots on odd number columns and the head-segments 5*a* (G3, C2, K1) of the segment group 5C1 would fire GCK inks onto dots on even number columns. In the first L-pass, to form alternate dots, the head-segments 5*a* (K1, C2, G3) of the segment group 5C1 would fire KCG inks onto dots on odd number columns and the head-segments 5*a* (M4, O5, Y6) of the segment group 5C2 would fire MOY inks onto dots on even number columns. In this way, one print swath would be completed in forward and reverse print passes. The above first R/L-pass would be repeated after the second R-pass.

The result of this method of driving is to create a swath of dot columns in which the dot densities alternate both the main and sub scan directions. For example, inks are overlapped in an order of YOMKCG onto a dot on #1 dot column in the scan line A. Inks are overlapped in an order of KCGYOM onto a dot on #1 dot column in the scan line B, that is, an adjacent dot in the sub scan direction. Inks are overlapped in an order of GCKMOY onto a dot on #2 dot column in the scan line A, that is, an adjacent dot in the main scan direction. Thus, this method can effectively average the chromatic error across both directions without restriction of the specific combination of ink colors.

Having described the embodiments consistent with the present invention, for chromatic averaging in adjacent swaths, which arranges different chromatic dots, caused from transportation passes of the inkjet head in the same print swath alternately in the main and sub scan directions in order to print with evenly distributed low and high brightness in ink colors. Other embodiments and variations, for example, to types and the number of the segment groups or head-segments of the inkjet head 5, consistent with the present invention will be apparent to those skilled in the art. Therefore, the invention should not be viewed as limited to the disclosed embodiments but rather should be viewed as limited only by the spirit and scope of the appended claims.

What is claimed is:

1. An inkjet printer, comprising:

an inkjet head having a plurality of nozzles arrayed in a main scan direction, each for firing a different color ink; and head control means for driving said inkjet head relative to a print medium in the main scan direction and a sub scan direction perpendicular to the main scan direction and for providing said inkjet head with firing pulses to fire inks in synchronization with said driving said inkjet head, in which droplets of said inks fired from said nozzles for respective colors are overlapped (or overlaid) at each dot-forming position on said print medium to form a color image, wherein said head control means provides said inkjet head with said firing pulses in such a manner that different chromatic dots, caused by the difference of the order of overlapped inks fired from respective nozzles of said inkjet head between the case of transporting said inkjet head on a first directional pass in the main scan direction and the case of transporting said inkjet head on a second directional pass opposite to said first directional pass, are alternately arranged in both the main and sub scan directions, wherein said inkjet head includes first and second segment groups aligned in the main scan direction, and wherein said inkjet head consists of six head-segments for forming one dot with different colors, said six head-segments being divided into said first and second groups each with three head-segments, each group being individually driven, said first segment group having nozzles aligned in the main scan direction in an order of the brightest color, a mid-bright color and the darkest color along said first directional pass from upstream to downstream, and said second segment group having nozzles aligned in the main scan direction in an order of the darkest color, a mid-bright color and the brightest color along said first directional pass from upstream to downstream, and said head control means providing said firing pulses to said inkjet head in such a manner that dots by said first segment group and dots by said second segment group are alternately formed during transporting said inkjet head in one pass of the main scan direction.

2. An inkjet printer, comprising:

an inkjet head having a plurality of nozzles arrayed in a main scan direction, each for firing a different color ink; and head control means for driving said inkjet head relative to a print medium in the main scan direction and a sub scan direction perpendicular to the main scan direction and for providing said inkjet head with firing pulses to fire inks in synchronization with said driving said inkjet head, in which droplets of said inks fired from said nozzles for respective colors are overlapped (or overlaid) at each dot-forming position on said print medium to form a color image, wherein said head control means provides said inkjet head with said firing pulses in such a manner that different chromatic dots, caused by the difference of the order of overlapped inks fired from respective nozzles of said inkjet head between the case of transporting said inkjet head on a first directional pass in the main scan direction and the case of transporting said inkjet head on a second directional pass opposite to said first directional pass, are alternately arranged in both the main and sub scan directions, wherein said inkjet head includes first and second segment groups arrayed in the main scan direction, each group being driven independently, each group being offset to the other by a certain dot pitch in the sub scan direction, each group having nozzles aligned in the main scan direction, each of said first and second segment groups having nozzles aligned along said first directional pass from upstream to downstream in an order of the brightest color, a mid-bright color and the darkest color, and said head control means providing said firing pulses to said inkjet head in such a manner that dots by said first segment group and dots by said second segment group are alternately formed at each dot location in the sub scan direction and every other dot location in the main scan direction in the case of transporting said inkjet head on said first directional pass in the main scan direction and subsequently, in the case of transporting said inkjet head on said second directional pass, dots are formed at intervals between said dots formed in the case of transporting said inkjet head on said first directional pass.

3. An inkjet printer, comprising:

an inkjet head having a plurality of nozzles arrayed in a main scan direction, each for firing a different color ink; and head control means for driving said inkjet head relative to a print medium in the main scan direction and a sub scan direction perpendicular to the main scan direction and for providing said inkjet head with firing pulses to fire inks in synchronization with said driving said inkjet head, in which droplets of said inks fired from said nozzles for respective colors are overlapped (or overlaid) at each dot-forming position on said print medium to form a color image, wherein said head control means provides said inkjet head with said firing pulses in such a manner that different chromatic dots, caused by the difference of the order of overlapped inks fired from respective nozzles of said inkjet head between the case of transporting said inkjet head on a first directional pass in the pain scan direction and the case of transporting said inkjet head on a second directional pass opposite to said first directional pass, are alternately arranged in both the main and sub scan directions, wherein-said head control means provides said firing pulses to said inkjet head in such a manner that dots are formed on odd dot locations in both the main scan direction and the sub scan direction with a first scan by said inkjet head traveling on said first directional pass in the main scan direction, subsequently dots are formed on even dot locations in the main scan direction and odd dot locations in the sub scan direction with a second scan by said inkjet head traveling on said second directional pass, then dots are formed on even dot locations in the main scan direction and even dot locations in the sub scan direction with a third scan by said inkjet head traveling on said first directional pass after shifting said inkjet head by a certain distance in the sub scan direction, and subsequently dots are formed on odd dot locations in the main scan direction and even dot locations in the sub scan direction with a fourth scan by said inkjet head traveling on said second directional pass.

4. An inkjet printer, comprising:

an inkjet head having a plurality of nozzles arrayed in a main scan direction, each for firing a different color ink; and head control means for driving said inkjet head relative to a print medium in the main scan direction and a sub scan direction perpendicular to the main scan direction and for providing said inkjet head with firing pulses to fire inks in synchronization with said driving said inkjet head, in which droplets of said inks fired from said nozzles for respective colors are overlapped (or overlaid) at each dot-forming position on said print medium to form a color image, wherein said head control means provides said inkjet head with said firing pulses in such a manner that different chromatic dots, caused by the difference of the order of overlapped inks fired from respective nozzles of said inkjet head between the case of transporting said inkjet head on a first directional pass in the main scan direction and the case of transporting said inkjet head on a second directional pass opposite to said first directional pass, are alternately arranged in both the main and sub scan directions, wherein said inkjet head consists of six head-segments for forming one dot with different colors, said six head-segments being divided into first and second groups each with three head-segments, each group being individually driven, each group being offset to the center by a certain dot pitch in the sub scan direction, each group having nozzles aligned in the main scan direction, each of said first and second segment groups having nozzles aligned along said first directional pass from upstream to downstream in an order of the brightest color, a mid-bright color and the darkest color, and said head control means providing said firing pulses to said inkjet head in such a manner that dots by said first segment group and dots by said second segment group are alternately formed at each dot location in the sub scan direction and every other dot location in the main scan direction in the case of transporting said inkjet head on said first directional pass in the main scan direction and subsequently, in the case of transporting said inkjet head on said second directional pass, dots are formed at intervals between said dots formed in the case of transporting said inkjet head on said first directional pass.

* * * * *

UNITED STATES PATENT AND TRADEMARK OFFICE

CERTIFICATE OF CORRECTION

PATENT NO. : 6,595,612 B1
DATED : July 22, 2003
INVENTOR(S) : Christopher M. Brown et al.

It is certified that error appears in the above-identified patent and that said Letters Patent is hereby corrected as shown below:

Column 14,
Line 61, "pain" should read -- main --.
Line 66, "wherein-said" should read -- wherein said --.

Signed and Sealed this

Thirtieth Day of December, 2003

JAMES E. ROGAN
*Director of the United States Patent and Trademark Office*